United States Patent [19]

Nickel

[11] Patent Number: 4,489,846

[45] Date of Patent: Dec. 25, 1984

[54] SELF-LEVELING BASE FOR TANK

[75] Inventor: Herbert W. Nickel, Germantown, Wis.

[73] Assignee: A. O. Smith Corporation, Milwaukee, Wis.

[21] Appl. No.: 539,682

[22] Filed: Oct. 6, 1983

[51] Int. Cl.[3] ..... B65D 25/20; B65D 90/12

[52] U.S. Cl. ..... 220/69; 220/18; 248/128

[58] Field of Search ..... 220/69, 85 K, 18, 435; 248/128, 149, 310, 346, 188.2, 188.3, 671, 678, 676, 133

[56] References Cited

U.S. PATENT DOCUMENTS

| | | | |
|---|---|---|---|
| 1,449,974 | 3/1923 | Crimmel | 248/128 |
| 1,810,774 | 6/1931 | Mackley | 220/69 X |
| 2,062,589 | 12/1936 | Lueas | 220/69 X |
| 2,067,581 | 1/1937 | Smith | 220/69 |
| 2,954,636 | 10/1960 | Gammache | 248/188.3 |
| 3,022,969 | 2/1962 | Fleckenstein et al. | 248/671 X |
| 3,497,101 | 2/1970 | Sagara et al. | 220/69 X |
| 3,840,141 | 10/1974 | Allom et al. | 220/69 X |
| 3,851,626 | 12/1974 | Boyd | 248/678 X |
| 4,161,426 | 7/1979 | Kneer | 248/128 X |

*Primary Examiner*—Allan N. Shoap

*Attorney, Agent, or Firm*—Andrus, Sceales, Starke & Sawall

[57] ABSTRACT

A self-levelling supporting base for a tank. The base includes an annular skirt having an upper rim disposed in contact with the lower dome-shaped head of the tank. A curved wall is connected to the rim and extends across the skirt and is spaced beneath the head. The wall is provided with a central opening to receive a member, such as a fluid pipe, that is connected to the lower head. A washer surrounds the member and the lower end of the member is engaged with a connector, such as a fitting, which acts to deform the wall and urge the rim into tight engagement with the head of the tank. The opening in the curved wall is substantially larger in diameter than the member with the result that the base can be shifted laterally to properly align the tank on an uneven supporting surface. A flexible lip extends upwardly from the rim in engagement with the head and acts to provide a seal between the tank and the base as well as increasing the frictional resistance between the base and the tank to aid in maintaining the tank in proper alignment on the base.

9 Claims, 4 Drawing Figures

FIG. 1
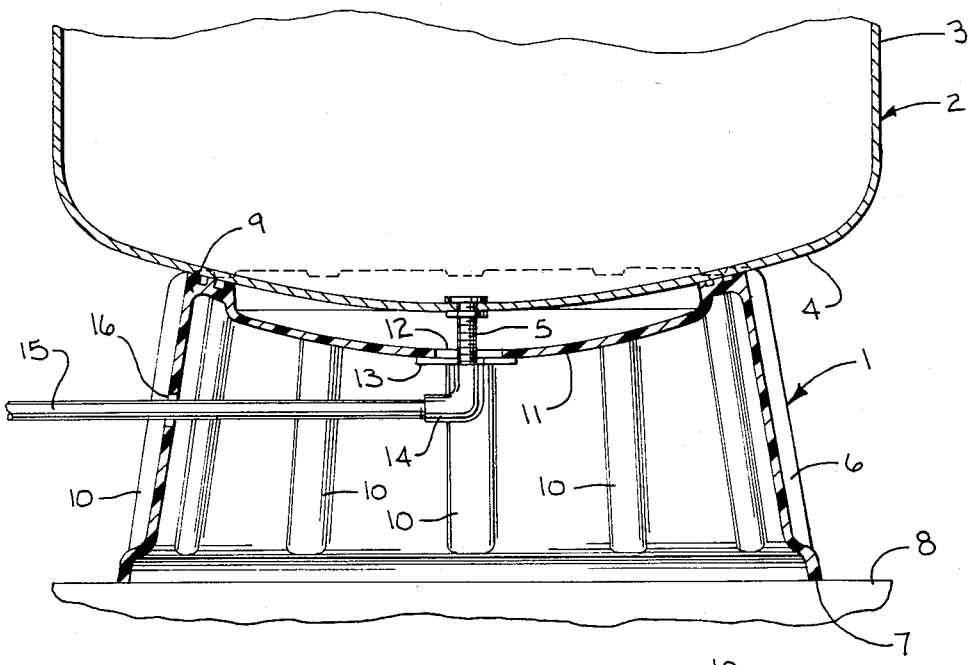
FIG. 2
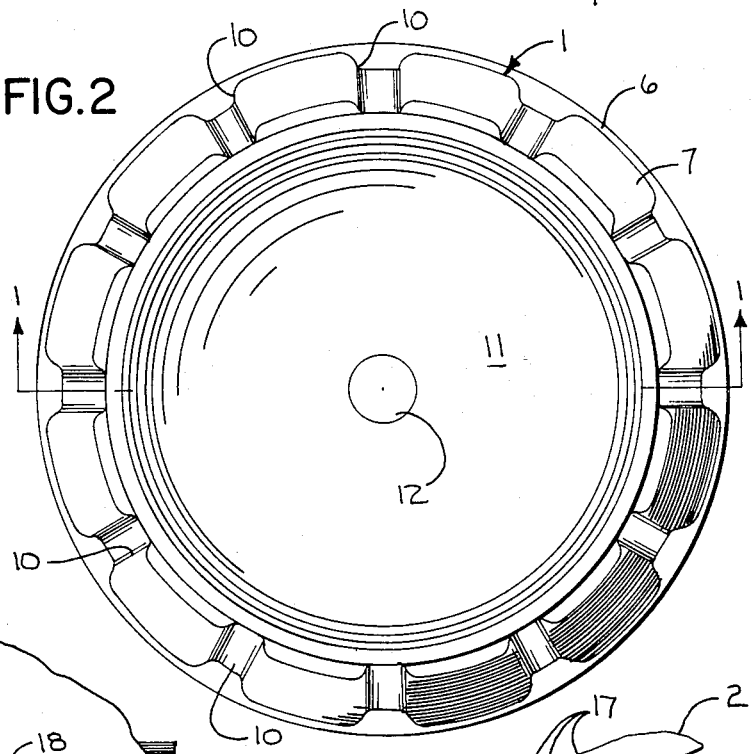
FIG. 4
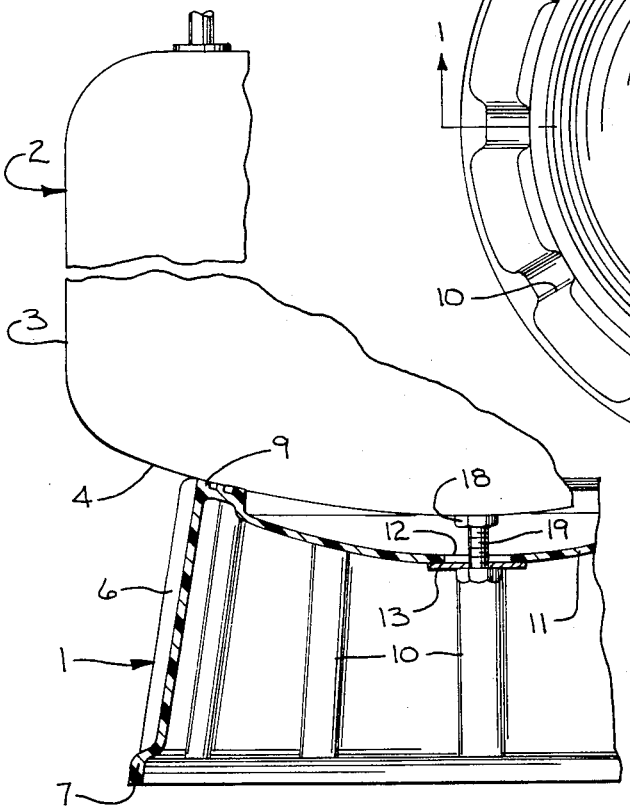
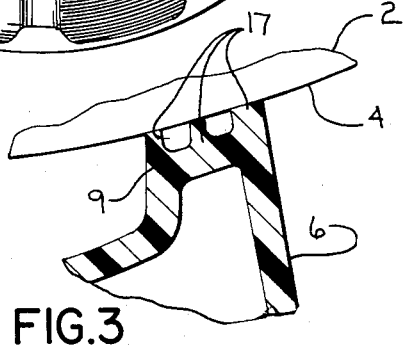
FIG. 3

SELF-LEVELING BASE FOR TANK

BACKGROUND OF THE INVENTION

Tanks, such as water softeners, water heaters, water filters, iron filters, hydropneumatic tanks, and the like, generally have dome-shaped lower heads. To install the tank in an upright position, a plurality of legs, or alternately, an annular skirt, are connected to the lower head and serve to support the tank from the floor or other supporting surface. As the surface on which the tank is supported is frequently uneven, it is necessary in the normal installation procedure to level or plumb the tank. To level a tank having permanently attached legs, shims are inserted under the legs to provide the level condition. With the use of an annular skirt, a series of stepped wedge-shaped blocks are inserted beneath the skirt at various locations around the circumference of the skirt to level the tank. As the use of the wedges results in high stress concentrations in the skirt directly above the wedges, it is the normal instructional procedure to support at least 50% of the circumference of the skirt or base with wedges.

As a further problem, supporting legs are normally welded to the tank and are occasionally broken or bent during shipment and handling. Furthermore, as the legs are normally metal, they are subjected to corrosion, particularly when the tank is used in a moist environment.

SUMMARY OF THE INVENTION

The invention is directed to a self-leveling supporting base for a tank. In accordance with the invention, the base includes a tapered annular skirt having an upper annular rim disposed in contact with the lower dome-shaped head of the tank and the lower edge of the skirt is adapted to rest on the supporting surface.

Connected to the rim is a downwardly curved wall which extends across the skirt and is spaced beneath the head of the tank. The curved wall is provided with an opening to receive a fluid outlet nipple which extends axially from the head. The lower end of the nipple receives a washer and a threaded connector, such as a fitting, and by turning down the connector, the curved wall will be deformed upwardly to urge the rim into tight engagement with the head of the tank. The opening in the curved wall is considerably larger than the outlet nipple and on installation of the tank at its site of use, the base can be moved relative to the tank to insure that the tank is properly positioned in an upright condition regardless of the uneveness of the supporting surface.

One or more annular flexible lips extend upwardly adjacent the rim and engage the dome-shaped head of the tank. The lips serve to provide a seal to prevent condensate from dripping downwardly along the tank into the interior of the base and the lips also increase the frictional resistance between the base and the tank head to thereby maintain the tank in the desired orientation with respect to the base.

The tank-supporting base of the invention is installed at the factory and it is merely necessary at the site of use to shift the base laterally, if necessary, to provide the proper upright alignment for the tank. No tools are required to install the tank in its proper upright condition and no auxiliary parts are required for the installation.

The base is preferably formed of a non-corrosive plastic material, such as molded polyethylene and as such, it is not only inexpensive to produce, but it is extremely durable and will aid in protecting the tank during shipment and handling.

The base can be used with all types of tanks having a dome-shaped head, such as water heaters, water softeners, water filters, iron filters, hydropneumatic tanks, and the like.

Other objects and advantages will appear in the course of the following description.

DESCRIPTION OF THE DRAWINGS

The drawings illustrate the best mode presently contemplated of carrying out the invention.

In the drawings:

FIG. 1 is a vertical section of the self-leveling base of the invention as applied to a tank;

FIG. 2 is a bottom view of the base shown in FIG. 1;

FIG. 3 is an enlarged fragmentary vertical section showing the lips on the base; and FIG. 4 is a vertical section of a modified form of the invention.

DESCRIPTION OF THE PREFERRED EMBODIMENT

FIG. 1 illustrates a self-leveling supporting base 1 for a tank 2. The tank can be any type of a tank which is normally positioned in an upright condition and can include a water softener tank, a water heater tank, a water filter tank, hydropneumatic tank, and the like.

The tank 2 includes a generally cylindrical shell 3 which is enclosed at its lower end by a dome-shaped head 4. In the embodiment shown in FIGS. 1–3, a nipple or tube 5 is secured centrally within an opening in head 4 and serves as either an entry or discharge conduit for fluid contained within the tank.

The base 1 comprises an upwardly tapering skirt 6 having an annular lower edge 7 which is adapted to rest on a supporting surface 8. The upper edge of skirt 6 defines an annular rim 9 which is disposed in contact with the outer surface of head 4 of tank 2.

Skirt 6 is preferably formed from a molded plastic material, such as polyethylene and to provide added strength and rigidity, a series of ribs 10 can be formed in the skirt.

As best shown in FIG. 2, base 1 also includes a downwardly curved internal wall 11, which is spaced beneath head 4. As illustrated in FIG. 2, the wall 11 has a lesser radius of curvature than the head 4, and is spaced a substantial distance beneath the head.

Formed centrally of wall 11 is an opening 12 which receives nipple 5. As shown in FIG. 4, the diameter of opening 12 is substantially greater than the outer diameter of nipple 5, so that the entire base 1 can be shifted laterally relative to the tank head 4. A washer 13, which has a larger outer diameter than the diameter of opening 12, is engaged with the lower surface of wall 11, and elbow 14 is threaded on the lower end of nipple 5. As shown in FIG. 2, a pipe 15 is threaded with the elbow 14 and extends through a hole 16 in skirt 6. By threading elbow 14 on the end of nipple 5, the wall 11 will be deformed upwardly to bring the rim 9 into tight bearing engagement with the lower surface of head 4.

To provide a seal between base 1 and the head 4 of the tank, one or more annular lips 17 are formed in rim 9. Lips 17 are flexible and bear against the lower surface of head 4 to provide a seal between tank 2 and base 1, thereby preventing condensation or other liquid from running downwardly into the interior of the base 1. Alternately, if lips 17 are not employed in rim 9, suitable drain holes can be formed in the curved wall 11, outwardly of the central opening 12 for drainage.

Base 1 is fully installed with tank 2 at the factory, with elbow 14 being threaded on the lower end of nipple 5. At the location of use, the installer merely lifts the tank so that the base 1 is above the ground and then can kick, or otherwise move, the base to shift it laterally relative to the tank to provide the desired alignment so that the tank will be installed in an upright condition.

FIG. 4 illustrates a modified form of the invention in which the tank 2 does not have a fluid conduit in the lower dome-shaped head 4, but instead, the fluid openings are either in the shell or in the upper head. In this case a nut 18 is welded centrally of the lower head 4 and a bolt 19 is inserted through washer 13, as well as through openings 12 in wall 11, and is threaded with the nut 18. By threading down bolt 19, the rim 9 will be drawn into tight engagement with the lower head 4 of the tank 2 as previously described.

As the base 1 is assembled with the tank at the factory, the base will aid in protecting the tank during shipment and handling. As a further advantage, no tools or auxiliary parts or fasteners are required in leveling the tank at the site of installation.

As the base is preferably formed of a molded thermoplastic material, it is inexpensive to produce, extremely durable and provides an attractive appearance for the tank.

Various modes of carrying out the invention are contemplated as being within the scope of the following claims particulary pointing out and distinctly claiming the subject matter which is regarded as the invention.

I claim:

1. In combination, a tank having a dome-shaped lower head, a member extending axially outward from said head, a base secured to said head and disposed to support the tank from a supporting surface, said base comprising a generally annular skirt having an upper rim disposed in contact with said head and having a lower edge resting on said supporting surface, a wall extending across said skirt and spaced beneath said head and having an opening to receive said member, the area of said opening being substantially greater than the area of said member whereby said base can be shifted laterally relative to said member, and connecting means connected to the lower end of said member and disposed in contact with the lower surface of said wall to cause said rim to be brought into firm engagement with said head, lateral shifting of said base relative to said head enabling said base to conform to uneven supporting surfaces.

2. The combination of claim 1, wherein said wall is attached to said skirt adjacent said rim, said wall being generally dome-shaped and having a smaller radius of curvature than the radius of curvature of said head.

3. The combination of claim 1, wherein said member is threaded and said connecting means comprises a washer surrounding said member and engaged with the lower surface of said wall, and a nut threaded on the lower end of said member.

4. The combination of claim 1, wherein said skirt is tapered upwardly.

5. The combination of claim 4, wherein said base is formed of molded plastic material.

6. The combination of claim 1, and including a flexible annular lip extending upwardly from said rim and disposed in contact with said head.

7. The combination of claim 1, wherein said member is a tube and said connecting means comprises a washer surrounding said tube and disposed in engagement with the lower surface of said wall, and a connector threadedly engaged with the lower end of said tube.

8. The combination of claim 1, wherein said member is a rod extending outwardly from said head.

9. In combination, a tank having a dome-shaped lower head and having a threaded member extending outwardly from said head, a base secured to the head and disposed to supporting the tank in an upright condition from a supporting surface, said base comprising a generally annular skirt having an upper rim disposed in contact with said head and having a lower edge resting on said supporting surface, a generally curved wall connected to the upper portion of said skirt and extending across said skirt, said wall being spaced beneath the head and having a central opening to receive said threaded member the area of said opening being substantially greater than the area of said threaded member, whereby the base can be shifted laterally with respect to said head, a washer surrounding said threaded member and disposed in contact with the lower surface of said wall, and threaded means threaded to the lower end of said threaded member, threading down of said threaded means causing deflection of said wall and bringing said rim into tight engagement with the head of said tank.

* * * * *